United States Patent [19]

Ugata et al.

[11] 4,078,035

[45] Mar. 7, 1978

[54] METHOD FOR MAKING DISPOSABLE MODEL FOR PRECISION INVESTMENT CASTING

[75] Inventors: Ken Ugata, Nara; Yasuji Morita, Kobe; Yasuharu Mine, Osaka; Hiroshi Izaki, Kashiwara, all of Japan

[73] Assignee: Kubota, Ltd., Osaka, Japan

[21] Appl. No.: 712,067

[22] Filed: Aug. 5, 1976

Related U.S. Application Data

[63] Continuation of Ser. No. 506,774, Sep. 17, 1974, abandoned.

[30] Foreign Application Priority Data

Sep. 20, 1973 Japan ..... 48/107369

[51] Int. Cl.[2] ..... B29C 1/08; B29C 5/00

[52] U.S. Cl. ..... 264/221; 106/38.3; 106/38.8; 249/62; 264/317; 264/337

[58] Field of Search ..... 264/317, 221, 337; 106/38.3, 38.8; 249/62

[56] References Cited

U.S. PATENT DOCUMENTS

| | | | |
|---|---|---|---|
| 3,263,285 | 8/1966 | Watts et al. | 164/114 |
| 3,528,809 | 9/1970 | Farnand | 264/111 |
| 3,686,006 | 8/1972 | Horton | 106/38.3 |
| 3,859,405 | 1/1975 | Horton | 106/38.35 |

*Primary Examiner*—Willard E. Hoag

*Attorney, Agent, or Firm*—Wenderoth, Lind & Ponack

[57] ABSTRACT

A method for making a disposable model for a precision investment casting, which comprises casting a naphthalene or para-dichlorobenzene-containing modeling material into a pattern mold at a temperature of 150° C or less, preferably 80 to 150° C and further preferably at a casting speed of 5 to 0.1 kg/second; the modeling material being optionally admixed with a resin selected from the group consisting of polystyrene, polyethylene, polyvinyl acetate and a mixture thereof as a reinforcing material or comprising a mixture of naphthalene or paradichlorobenzene (preferably 80 to 30% by weight), a wax (preferably 20 to 70% by weight) and the resin as mentioned above (preferably 0.5 to 15% by weight on the basis of the whole weight of the modeling material).

3 Claims, No Drawings

METHOD FOR MAKING DISPOSABLE MODEL FOR PRECISION INVESTMENT CASTING

This is a continuation, of application Ser. No. 506,744, filed Sept. 17, 1974, and now abandoned.

The present invention relates to a method for making a disposable model for a precision investment casting. More particularly, it relates to an improved method for making a disposable model for a precision investment casting by using a new naphthalene or para-dichlorobenzene-containing modeling material.

Generally, in a precision investment casting, particularly in so-called "lost wax process", a wax is used as the modeling material. However, the wax has high shrink characteristics, and therefore, when it is molded, a deformation or shrinkage occurs. Accordingly, for obtaining a precise model for a precision investment casting, the wax should be injection-molded under a high pressure and at a temperature as low as possible at which the wax is in a state of semi-molten state (i.e. in a pasty state). Besides, when a wax having less shrink characteristics is used, it must be combined with various components, which results in high cost, and therefore, such method is not economical.

The present inventors have studied to find a new modeling material useful for making a disposable model for a precision investment casting and further to find a new method for the molding, and then, it has been found that the desired disposable model can be obtained by casting a naphthalene or paradichlorobenzene-containing modeling material into a pattern mold under controlling the temperature.

An object of the present invention is to provide an improved method for making a disposable model for a precision investment casting.

Another object of the invention is to provide a naphthalene or para-dichlorobenzene-containing modeling material useful for making a disposable model which is used in a precision investement casting.

These and other objects will be apparent from the description hereinafter.

Generally, the modeling material suitable for making a disposable model for a precision investment casting should have the following conditions:

(1) it is not softened and deformed at room temperature, (2) it has less shrinkage at the solidification, (3) it has a small coefficient of thermal expansion, (4) it has a low melting point and excellent casting properties, (5) the property does not change by heating, (6) it is easily molten and removed, and (7) it has a hard surface and toughness.

The present inventors have studied to find a modeling material satisfying the above-mentioned conditions and then found that a naphthalene or para-dichlorobenzene-containing modeling material is a preferred one.

The naphthalene or para-dichlorobenzene-containing modeling material has excellent casting properties and molding properties and therefore can be molded by casting it into a gypsum mold. However, when the naphthalene or para-dichlorobenzene-containing modeling material is molded by a conventional method, the model thus obtained has a defect that the surface thereof has pores and white spots. Then, the present inventors have further studied to find a method for making a good disposable model having no such defects and then found that the desired product can be obtained by casting it into a pattern mold under controlling the temperature, and further the casting speed.

That is, according to the present invention, the naphthalene or para-dichlorobenzene-containing modeling material is casted into a pattern mold at a temperature of 150° C or lower, preferably 80° to 150° C and at a casting speed of 5 to 0.1 kg/second to give the desired disposable model.

According to the present inventors' new finding, the pores and the white spots on the surface of the model are caused by the deposition of the sublimed naphthalene or para-dichlorobenzene and other components on the wall of the mold when the naphthalene or para-dichlorobenzene-containing modeling material is casted, and such defects can be removed by controlling the casting temperature at 150° C or lower and further the casting speed to 5 to 1 kg/second in case of a simple model, particularly in case of a longitudinally large model and to 1.5 to 0.1 kg/second in case of a complex model, particularly in case of a longitudinally small model.

According to the method of the present invention, the naphthalene or para-dichlorobenzene-containing modeling material is molten and casted into a pattern mold at a temperature of 150° C or lower and further preferably at a casting speed of 5 to 0.1 kg/second, and then solidified to give the desired model having no defects such as pores and white spots on the surface.

The modeling material used in the present invention comprises naphthalene or para-dichlorobenzene.

The naphthalene and the para-dichlorobenzene have the molecular formula and physical properties as shown in the following Table 1.

Table 1

| | Molecular formula | Melting point (° C) | Boiling point (° C) | Specific gravity |
|---|---|---|---|---|
| Naphthalene | $C_{10}H_8$ | 80.2 | 217.9 | 1.145 |
| Para-dichlorobenzene | $C_6H_4Cl_2$ | 53.1 | 174.4 | 1.458 |

The naphthalene or para-dichlorobenzene becomes easily a liquid having good fluidity by heating it over the melting point and can be easily solidified wherein it is crystallized, and the apparent volume change is extremely small. The naphthalene and pare-dichlorobenzene have preferably high purity as possible.

The modeling material of the present invention may contain a resin selected from the group consisting of polystyrene, polyethylene, polyvinyl acetate and a mixture thereof as a reinforcing material in addition to the naphthalene or para-dichlorobenzene. The resin may be preferably admixed in an amount of 20% by weight or less on the basis of the whole weight of the modeling material. When the resin is admixed in an amount of more than 20% by weight, the shrinkage and the coefficient of thermal expansion of the model increase, which results occasionally in the occurrence of warpage and thereby a desirable precise model can hardly be obtained. Furthermore, the strength of the model is no more increased even by using the resin of more than 20% by weight.

Alternatively, the modeling material of the present invention may comprise naphthalene or para-dichlorobenzene, a wax and a resin selected from the group consisting of polystyrene, polyethylene, polyvinyl acetate and a mixture thereof. That is, the alternative modeling material comprises a mixture of a wax (e.g. paraffin wax, stearin, ceresin, brown coal wax, peat wax, etc.) and naphthalene or para-dichlorobenzene as the base material and thereto a small amount of the resin is added as a reinforcing material. The wax is admixed in a ratio of 80% by weight or less to the naphthalene or para-dichlorobenzene. The preferred ratio of the wax and the naphthalene or para-dichlorobenzene is 20 to 70% by weight (wax) and 80 to 30% by weight (naphthalene or para-dichlorobenzene), respectively. According to this modeling material, the good properties of both the wax and the naphthalene or para-dichlorobenzene (e.g. smooth surface by the wax and good dimensional accuracy and molding properties by the naphthalene or para-dichlorobenzene) can be exhibited. On the other hand, the defects of both substances are negated from each other, that is, the inferior dimension accuracy and large shrinkage by the wax are negated by the naphthalene or para-dichlorobenzene, and further, the bad surface smoothness and the occurrence of deposition of the sublimed substances by the naphthalene or para-dichlorobenzene are negated by the wax. The mechanical strength of the modeling material can be increased by admixing the resin as mentioned above, and thereby the necessary hardness is given to the model obtained therefrom.

When the wax is admixed in a ratio of less than 20% by weight, the surface of the obtained model is inferior, and on the other hand, when the amount of the wax is over 80% by weight, the shrinkage factor increases and further dimension accuracy of the material decreases.

When the naphthalene or para-dichlorobenzene is admixed in a ratio of more than 80% by weight, the smoothness of the surface of the obtained model decreases, and on the other hand, when it is less than 30% by weight, no good dimension accuracy is obtained.

The resin may be admixed with the mixture of wax and naphthalene or para-dichlorobenzene in an amount of 20% by weight or less, preferably 0.5 to 15% by weight on the basis of the whole weight of the modeling material. When the resin is admixed in an amount of less than 0.5% by weight on the basis of the whole weight of the modeling material, no reinforcing effect is given, and on the other hand, when the amount of the resin is over 20% by weight, it results in increase of thermal expansion and shrinkage factor of the material and further in deterioration of the dimension accuracy of the product.

The various properties of the present modeling material and the conventional wax-base material are shown in Table 2. The components of the materials are shown in Tables 3 and 4. The modeling material of the present invention has extremely small free linear shrinkage factor when it is casted in a molten state, which is smaller than that when a pasty wax is injection-molded, as shown in Table 2. Besides, the coefficient of linear expansion of the present material is extremely smaller than that of the wax.

Table 2

| | Free linear shrinkage factor (%) | | Bending strength (kg/cm$^2$) | | Temperature in pasty state (° C) | Melting point (° C) | Coefficient of linear expansion ($\times 10^{-5}$) |
|---|---|---|---|---|---|---|---|
| | Molten state | Pasty state | Molten state | Pasty state | | | |
| Conventional wax-base material | | | | | | | |
| 1 | 1.5 | 0.7–0.8 | 22–23 | 18–20 | 42–44 | — | 42–52(20–40° C) |
| 2 | 1.5 | 1.05 | — | 25–28 | 55–59 | — | — |
| 3 | — | 1.0–1.18 | — | 31–42 | 56–58 | — | — |
| The modeling material of the present invention | | | | | | | |
| 1 | 0.23 | — | 6.8 | — | — | 80 | 0.87(35–75° C) |
| 2 | 0.26 | — | 20.8 | — | — | 80 | 0.57(35–75° C) |
| 3 | 0.4 | — | 25.5 | — | — | 80 | 1.82(35–75° C) |
| 4 | 0.5 | — | 31.0 | — | — | 80 | 1.56(35–75° C) |
| 5 | 0.5 | — | 34.0 | — | — | 80 | 2.11(35–75° C) |
| 6 | 0.7 | — | 37.4 | — | — | 80 | — |
| 7 | 0.3 | — | 19.8 | — | — | 80 | — |
| 8 | 0.6 | — | 25.9 | — | — | 80 | — |
| 9 | 1.0 | — | 21.8 | — | — | 80 | — |
| 10 | 0.85 | — | 15.9 | — | — | 80 | — |
| 11 | 1.1 | — | 21.6 | — | — | 80 | — |
| 12 | 1.6 | — | 26.0 | — | — | 80 | — |

Table 3

| | (% by weight) | | | | | | |
|---|---|---|---|---|---|---|---|
| | Paraffin | Stearin | Ceresin | Brown coal wax | Peat wax | Rosin | Distillation residue of pyrogenous paraffin |
| Conventional wax-base material | | | | | | | |
| 1 | 50 | 50 | — | — | — | — | — |
| 2 | 58 | — | 25 | 12 | — | — | 5 |
| 3 | 60 | — | — | 18 | 15 | 7 | — |

Table 4

| | (% by weight) | | | |
|---|---|---|---|---|
| | Naphthalene | Poly-styrene | Ethylene-vinyl acetate copolymer | Poly-ethylene |
| The modeling material of the present invention | | | | |
| 1 | 100 | — | — | — |
| 2 | 99.5 | 0.5 | — | — |
| 3 | 99.0 | 1.0 | — | — |
| 4 | 97.0 | 3.0 | — | — |
| 5 | 95.0 | 5.0 | — | — |
| 6 | 90.0 | 10.0 | — | — |
| 7 | 99.0 | — | 1.0 | — |
| 8 | 97.0 | — | 3.0 | — |
| 9 | 95.0 | — | 5.0 | — |

Table 4-continued

| | Naphthalene | Poly-styrene | (% by weight) Ethylene-vinyl acetate copolymer | Poly-ethylene |
|---|---|---|---|---|
| 10 | 97.0 | — | — | 3.0 |
| 11 | 95.0 | — | — | 5.0 |
| 12 | 90.0 | — | — | 10.0 |

The disposable model produced by the present invention may be coated with a slurry of a refractory material (e.g. zircon flour, fused silica flour, alumina flour, etc.) and a binder (e.g. colloidal silica, hydrolyzed ethyl silicate, etc.) by a conventional method which is applied by the product by the lost wax process, that is, the formed model is coated with a slurry of a refractory material and a binder, and when the slurry is not yet dried, the resultant is subjected to sanding and then dried. The procedure is repeated for several times to give a shell having about 5 to 10 mm in thickness on the model.

The formed model having a shell of a refractory material is then immersed in hot water or heated rapidly at a high temperature and thereby the model is easily lost.

The modeling material used in the present invention is not deteriorated by heating, and therefore, the modeling material molten out by the above melting out procedure can be repeatedly used.

According to the present invention, the modeling material is molten and then casted into a pattern mold to give a more precise model than that by using a conventional wax-base material, and further there is less danger of the destruction of the shell caused by the thermal expansion, which is sometimes observed when the formed model is applied with a refractory multiple coating and then lost by heating, in comparison with the product produced by using a conventional wax-base material. Moreover, according to the present invention, it is not necessary to prepare a metal mold which has been mainly used in the lost wax process, and further the desired precise model can be produced without injection machine which is essential for molding by using the conventional wax-base material, which results in low cost of the precision investment casting.

The disposable model produced by the present invention is useful for the production of various precision investment cast articles, such as a steam turbine blade, a gas turbine blade, a metal mold for shell casting, press mold, or the like.

The present invention is illustrated by the following Example but not limited thereto, wherein part is part by weight.

EXAMPLE

A mixture of naphthalene (100 parts) and polystyrene (1 parts; 1% by weight on the basis of the weight of naphthalene) is molten by heating at 80° - 85° C in a vessel. The molten mixture is casted into a gypsum mold having a turbine blade (length: about 500 mm) at the same temperature without any pressure. After solidifying completely, the formed model is drawn out from the pattern mold. The model thus formed has little shrinkage and no warpage. To the formed model is applied a slurry of colloidal silica and fused silica flour, and the resultant is subjected to sanding and then dried. This procedure is repeated for 8 times to give a model having a shell of silica (thickness: 7 mm). The model having a shell the outer face of the model is molten out, and as the result, the remaining model can be taken out from the shell. The shell is then calcined. By using the shell, a molten 18–8 stainless steel is casted thereto to give a cast product having good dimension accuracy and good surface.

What is claimed is:

1. A method for making a disposable model for a precision investment casting, which comprises casting a modeling material consisting essentially of naphthalene or para-dichlorobenzene into a pattern mold at a temperature of 80°–150° C and at a casting speed of 5 to 0.1 kg/second.

2. A method for making a disposable model for a precision inventment casting, which comprises casting a modeling material consisting essentially of naphthalene or para-dichlorobenzene and a resin selected from the group consisting of polystyrene, polyethylene, polyvinyl acetate and mixtures thereof, said resin being contained in an amount of 20% by weight of less on the basis of the whole weight of the modeling material, into a pattern mold at a temperature of 80° to 150° C and at a casting speed of 5 to 0.1 kg/second.

3. The method according to claim 2, wherein the resin is contained in an amount of 0.5 to 15% by weight on the basis of the whole weight of the modeling material.

* * * * *